United States Patent [19]

Robinson et al.

[11] 4,107,955

[45] Aug. 22, 1978

[54] METHOD OF KNITTING BLANK FOR A SLEEVED GARMENT AND PRODUCT THEREOF

[75] Inventors: Frank Robinson; Nigel Stephen Whatmough, both of Breaston, England

[73] Assignee: Courtaulds Limited, London, England

[21] Appl. No.: 787,226

[22] Filed: Apr. 13, 1977

[51] Int. Cl.[2] ..... A41B 9/06

[52] U.S. Cl. ..... 66/176

[58] Field of Search ..... 66/176, 175

[56] References Cited

U.S. PATENT DOCUMENTS

| | | | |
|---|---|---|---|
| 2,406,969 | 9/1946 | Silman | 66/176 |
| 3,043,123 | 7/1962 | Goodman | 66/176 |
| 3,057,178 | 10/1962 | Konklin | 66/176 |
| 3,635,051 | 1/1972 | Betts et al. | 66/176 |
| 3,882,697 | 3/1975 | Betts et al. | 66/176 |

FOREIGN PATENT DOCUMENTS

| | | | |
|---|---|---|---|
| 1,494,335 | 7/1967 | France | 66/176 |
| 452,770 | 5/1968 | Switzerland | 66/176 |

*Primary Examiner*—Ronald Feldbaum
*Attorney, Agent, or Firm*—Davis, Hoxie, Faithfull & Hapgood

[57] ABSTRACT

A method of knitting a blank for a sleeved garment includes the steps of commencing knitting from an end of one sleeve and knitting in succession a single piece of fabric constituting this sleeve, a shoulder region of the garment and the second sleeve thereof with the wales of the knitting extending continuously through the sleeves and the shoulder region. Contemporaneously with the knitting of the first piece of fabric there is knitted a piece of fabric constituting the body of the garment which is started at an edge of the body part of the blank and has its wales extending across the body part. During the knitting of these pieces of fabric, at least a portion of the body part of the blank and the shoulder region are knitted so that courses are continuous between this body portion and the shoulder region, so that the blank comprises, in one piece of knitting, body, sleeve and shoulder parts of the garment.

Various methods of knitting the blank are described which result in the sleeves, in the finished garment, either being disposed at right angles to the body or being downwardly inclined from the shoulder region.

13 Claims, 5 Drawing Figures

METHOD OF KNITTING BLANK FOR A SLEEVED GARMENT AND PRODUCT THEREOF

Figure 1:
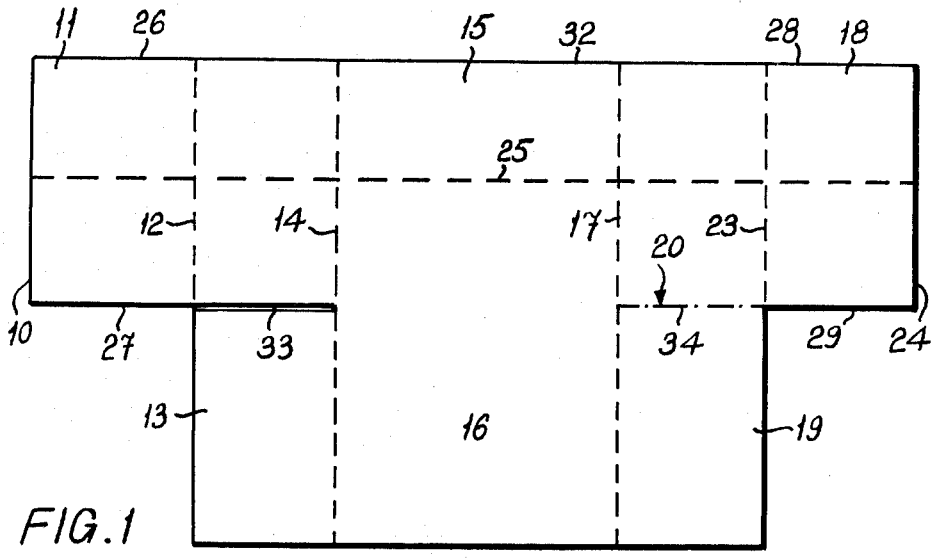

This invention relates to the production of knitted garments and is concerned with a method of knitting blanks for garments having sleeves, with the production of garments from the blanks, and with the garments thus produced.

It is an advantage of the method that it can be used to produce garment blanks in one piece comprising all the main parts of the garment. To produce a garment from such a blank merely required that some free edges of the blank should be seamed to one another and that some final finishing such as trimming of the neck and attachment of fastenings should be carried out.

According to one aspect of the invention, a method of knitting a blank for a sleeved garment comprises starting knitting from an end of a sleeve of the garment and knitting in succession fabric constituting said sleeve, a shoulder region of the garment and the second sleeve of the garment, in one piece, with courses extending in the direction across the sleeve blanks (around the sleeves in the finished garment) and with wales extending continuously through the sleeves and said shoulder region, and knitting fabric constituting the body of the garment, in one piece, contemporaneously with the sleeves and shoulder region starting at an edge of the body part of the blank and knitting so that wales extend across the body part of the blank (around the body in the finished garment), and knitting at least a portion of the body part of the blank and said shoulder region so that courses are continuous between said body portion and said shoulder region, said blank thus comprising, in one piece of knitting, body, sleeve and shoulder parts of the garment.

Said shoulder region of the garment may have a width in the course direction equal to the width in the course direction of each sleeve, that is the shoulder region may have a number of wales equal to the number of wales in each sleeve.

Alternatively, said shoulder region may have a width in the course direction equal to less than, for example half, the width in the course direction of each sleeve. The shoulder region then comprises a smaller number, for example half the number, of wales compared with the number of wales in each sleeve.

In such a case, said shoulder region may constitute only part of the shoulder area of the garment and the remaining part of the garment shoulder area may be constituted by at least one extension knitted onto a sleeve of the garment.

The method of the invention may be performed so that, in the finished garment, the wales of the sleeves are disposed substantially parallel to the wales of said shoulder region. Alternatively, the method may be performed so that, in the finished garment, the sleeves are caused to assume a downward inclination in relation to said shoulder region.

The method of the invention can be carried out on a knitting machine having needles arranged in a single needle bed or in two opposed needle beds, that is the blanks can be knitted in single jersey fabric or in double jersey fabric. The knitting machine used must have the capability of knitting on some needles of the machine whilst adjacent needles remain inactive but retain in their hooks knitted loops of the blank. The knitting machine must also have the capability of starting up knitting on bare needles. A preferred machine for carrying out the present method is the V-flat knitting machine JDR manufactured by Edouard Dubied & Cie. of Neuchatel, Switzerland and fitted with a PM (presser foot) attachment.

According to a further aspect of the invention, a blank for a sleeve garment comprises, in one piece, fabric constituting sleeves and a shoulder region of the garment and fabric constituting the garment body, wherein courses of one part of the body fabric are continuous with courses of said shoulder region and at least one other part of the body fabric, having wales continuous with wales of said one part of the body fabric, is knitted separately from said fabric constituting said sleeves and shoulder region so that courses are not continuous between said one other part of the body fabric and said sleeve and shoulder region fabric.

Figure 2:
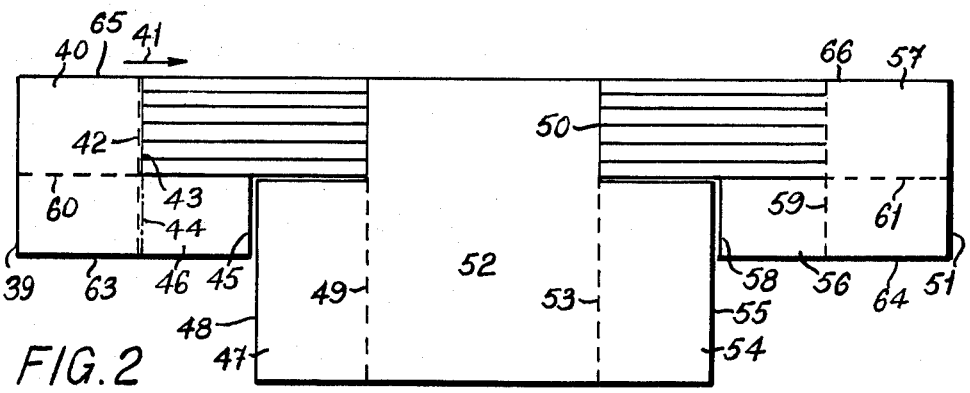
Figure 3:
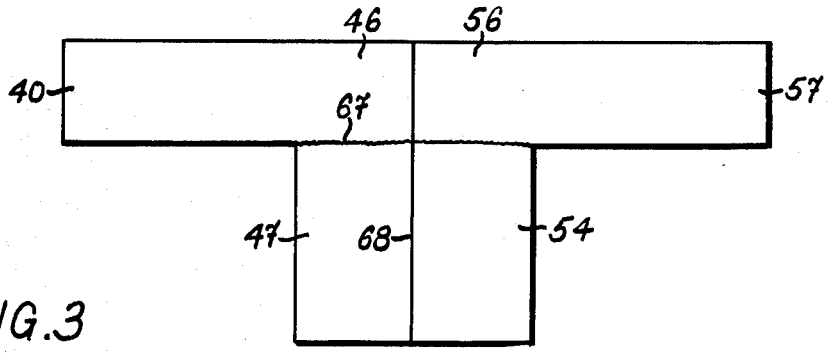

The invention will be further described, by way of example, with reference to the accompanying drawings, in which FIGS. 1, 2, 4 and 5 are schematic diagrams of four different garment blanks knitted by the method of the invention, and FIG. 3 shows the garment blank of FIG. 2 after making up.

The knitting methods to be described produce garments with fashioning or shaping at the front but not at the back, thus utilising the flexibility of knitted fabric to achieve the required fit at the back.

The garment blank shown in FIG. 1 is knitted starting at the end 10 of the sleeve 11. The courses of knitting extend across the sleeve blank (vertically in the Figure) and will extend around the sleeve in the finished garment, and the wales extend along the sleeve blank (horizontally in the Figure). At the course 12, knitting of a front part 13 of the body of the blank is begun. The part 13 is shown in the present embodiment of the invention as having been knitted separately from the sleeve 11, that is, it is knitted using yarn from a different supply and carried through different yarn carriers from the yarn used to knit the sleeve. However, the sleeve 11 and the part 13 of the body may be knitted in one piece, with courses of knitting continuous between the sleeve 11 and the part 13.

The course 14 is the last course of the sleeve 11 and of the front body part 13. Knitting continues without interruption, however, into a shoulder region 15 and a back body panel 16 of the garment, the courses of knitting being continuous between the two. The course 17 is the last course of the shoulder region 15 and of the body panel 16 but knitting continues without interruption into sleeve 18 and a second front body part 19 of the garment. Again, the part 19 may have courses continuous with courses of the sleeve 18 or may be knitted from separate yarn supplies so that the sleeve 18 and body part 19 are separated along a line 20 at the under-arm level on the body of the garment.

Knitting of the body part 19 is halted at the course 23 and knitting of the sleeve 18 continues to the course 24 where the blank is cast off the needles of the machine.

In the method just described, the parts of the garment blank are knitted in a single operation to produce a blank comprising, in one piece of knitting, body parts, sleeves and shoulder region of the garment. Knitting of the body part proceeds contemporaneously with the knitting of the sleeves and shoulder region.

To produce a garment from the blank of FIG. 1, the body parts 13 and 19, if knitted so as to be joined directly to the sleeves 11 and 18, respectively, are first severed from the sleeves along the line 20. The body is then folded along the courses 14 and 17 so that the body parts 13 and 19 lie on top of the back body panel 16. The sleeves 11 and 18 and the shoulder region 15 are folded about the line 25. The edges 26, 27 and 28, 29 of the sleeves are seamed together and the edge 32 of the shoulder region 15 is seamed to the edges 33 and 34 of the body parts 13 and 19. A neck opening (not shown) is cut in the shoulder region 15 and the courses 12 and 23 of the body parts 13 and 19 are either seamed together or provided with suitable releasable fastening means, for example a zip-fastener or buttons.

The garment blank shown in FIG. 2 is knitted starting at the end 39 of the sleeve 40 and knitting in the direction of the arrow 41. After the course 42 has been knitted, the needles holding loops along the line 43 extending over half the width of the sleeve are taken out of action whilst retaining their loops. Knitting continues on needles holding loops in the line 44 but at the course 45 the loops in this course are cast off. The extension 46 of the sleeve 40, from the course 42 to the course 45, will later constitute a part of the shoulder area of the garment.

Knitting of a front body panel 47 of the garment is then begun by casting on stitches in the line 48 on bare needles. At the course 49, the needles holding loops in the line 43, which are still inactive, are brought back into action to begin the knitting of the back body panel 52. When this is completed at the course 53, the needles originally holding the loops in the line 43 are again taken out of action whilst retaining their loops in line 50 and knitting continues on a reduced number of needles to knit the front body panel 54. When this panel is completed, the loops in the course 55 are cast off the needles.

Knitting of an extension 56 of the sleeve 57 is then begun by casting on loops along line 58 onto bare needles. When the extension 56 is completed at course 59, the courses are lengthened from half a sleeve width to the whole width of the sleeve 57 by bringing back into action the inactive needles holding loops in the line 50. Knitting then continues to the end 51 of the sleeve 57.

To make up a garment from the blank after casting it off the needles, the sleeves are folded along lines 60 and 61 so that edges 63 and 64 lie on top of edges 65 and 66 and these edges are seamed together. The front panels 47 and 54 are folded to lie on top of the back body panel 52 and the sleeve extensions 46 and 56 are seamed to the panels 47 and 54 along the line 67 (see FIG. 3). A neck opening (not shown) is cut out and the extensions 46 and 56 and panels 47 and 54 are seamed together along the line 68 or are provided with suitable releasable fastening means, for example a zip-fastener or buttons.

Figure 4:
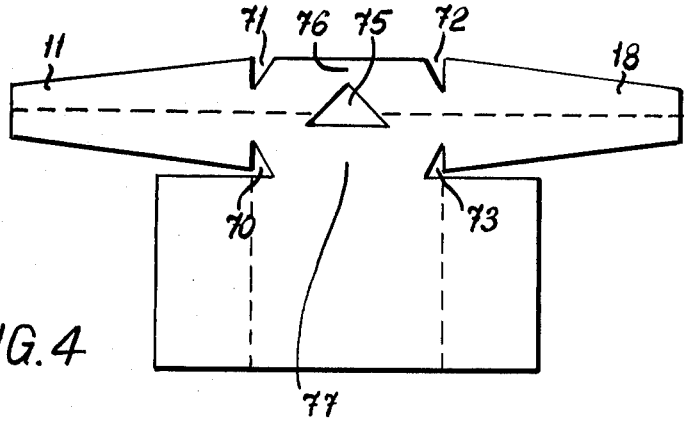

In order to obtain a desired downward inclination of the sleeves 11 and 18 to the body of the garment in a blank similar to that of FIG. 1, triangular apertures 70, 71, 72 and 73 as shown in FIG. 4 may be left on the border lines dividing the sleeves from the shoulder region 15. The apertures are formed by shortening and again lengthening the course knitted in the sleeves and shoulder region and each aperture may enter solely a sleeve or the shoulder region 15 or both of those fabric areas.

The sleeves may also be shaped as shown in FIG. 4 by progressively increasing (in the case of sleeve 11) and progressively decreasing (in the case of sleeve 18) the courses used in knitting them. Further, yarn can be saved by leaving an aperture 75 for the neck opening, as shown in FIG. 4. This is achieved by controlling the appropriate needles so that they do not knit and supplying yarn to the part-courses on opposite sides of the aperture 75, that is in regions 76 and 77, from different yarn carriers.

Figure 5:
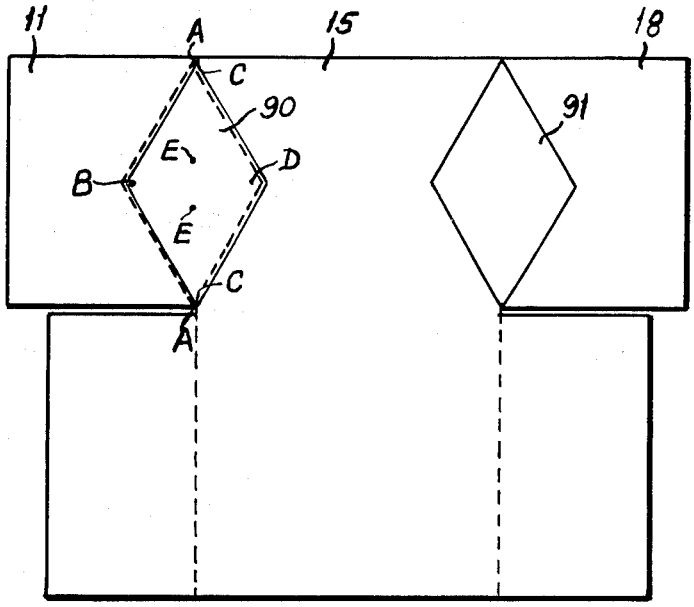

The garment blank of FIG. 5 has sleeves 11 and 18 which are caused to have a downward inclination in relation to the body in the finished garment by means of a technique employing courses of varying length in the sleeves 11 and 18 and shoulder region 15.

This can be done by two methods which will be described below.

In the first method, when the course A—A (shown as a broken line) is reached in the blank, all the needles are stopped but retain their loops. Knitting is then continued on one or a plurality of needles holding loops in the region B and in successive courses, additional needles are brought into action at both sides of those needles so that the courses progressively increase in length to C—C. Needles are then progressively taken out of action in an inwards direction from both ends of the bank of active needles until only one or a plurality of needles at D are knitting whereupon all the needles holding loops in the fabric between A and A are operated to knit and knitting of the shoulder region is continued. The result is the formation of a pouch 90 at the junction of the sleeve 11 and the shoulder region 15 of the garment whereby wales of the sleeve and shoulder region are longer in the central portion thereof than in portions to each side of the central portion.

The pouch 90 may instead be formed by decreasing the course length in successive courses after the course A—A. The courses are decreased in length from both ends of the bank of active needles until the course E—E is reached. A corresponding progressive increase in course length then takes place up to the course C-D-C whereafter knitting is continued on all needles holding loops.

Whichever procedure is used to form the pouch 90 is also used to form a further pouch 91 at the junction of the shoulder region 15 and the sleeve 18.

The procedures described in relation to FIGS. 4 and 5 can also be used in knitting garment blanks similar to that shown in FIGS. 2 and 3.

What is claimed is:

1. A method of knitting a blank for a sleeved garment, the method comprising the steps of (a) knitting a sleeve for the garment starting at one end so that the wales extend longitudinally of the sleeve, (b) knitting a shoulder region for the garment as a continuation of said sleeve so that wales extend along the sleeve and into the shoulder region, (c) lengthening the knitted courses when knitting said shoulder region so that the courses extend to one side of the shoulder region into a body part of said blank whereby knitting of said body part is carried out contemporaneously with the knitting of said shoulder region, (d) knitting a second sleeve for the garment as a continuation of said shoulder region, so that wales extend in a continuous line through the sleeves and said shoulder region, and (e) knitting at least one further part of said body integral with said first mentioned body part so that wales of said at least one further body part extend into said first mentioned body part.

2. A method as claimed in claim 1, wherein said shoulder region has a width in the course direction equal to the width in the course direction of each sleeve.

3. A method as claimed in claim 1, wherein said shoulder region has a width in the course direction equal to less than the width in the course direction of each sleeve.

4. A method as claimed in claim 3, wherein said shoulder region constitutes part only of the shoulder area of the garment, and the remaining part of the garment shoulder area is constituted by at least one extension knitted onto a sleeve of the garment.

5. A method as claimed in claim 1, wherein, during knitting of the fabric constituting the sleeves and said shoulder region, apertures are formed in said fabric by shortening and again lengthening the knitted courses in areas associated with lines dividing each sleeve from the shoulder region and each aperture extending into the fabric from an edge of a sleeve and/or the shoulder region, whereby when said fabric is folded to close said apertures the sleeves are caused to assume a downward inclination in relation to said shoulder region.

6. A method as claimed in claim 1, wherein, during knitting of the fabric constituting the sleeves and said shoulder region, a pouch is knitted in the area associated with the line dividing each sleeve from said shoulder region, each pouch being formed by knitting courses of different length so that wales are longer along the upper shoulder line and outer arm line in the garment and the sleeves are thus caused to assume a downward inclination in relation to said shoulder region in the finished garment.

7. A method as claimed in claim 6, wherein, at the start of each pouch, knitting is stopped on all needles holding loops of the fabric constituting the sleeves and said shoulder region, the knitting is continued on one or a plurality of needles in a central region course-wise of said fabric and courses are subsequently increased in length to a maximum and thereafter decreased again before knitting is once more continued on all said needles.

8. A method as claimed in claim 6, wherein in knitting each pouch courses are decreased in length to a minimum number of needles located in a central region course-wise of said fabric constituting the sleeves and said shoulder region, and courses are subsequently increased again until knitting is continued on all needles holding loops of said fabric.

9. A knitted blank for a sleeved garment comprising, in one piece, (a) fabric constituting sleeves of the garment and a shoulder region of the garment intermediate said sleeves, wherein knitted wales extend longitudinally of the sleeves and through said shoulder region, and (b) body fabric of the garment located entirely to one side of said sleeves and shoulder region fabric, courses of part of said body fabric being continuous with courses of said shoulder region, to provide a one-piece join between the body and the sleeve-shoulder region of the garment.

10. A blank as claimed in claim 9, wherein said shoulder region has a width in the course direction equal to less than the width in the course direction of each sleeve.

11. A blank as claimed in claim 10, wherein said shoulder region constitutes part only of the shoulder area of the garment and the remaining part of the shoulder area is constituted by at least one piece of extension fabric having wales continuous with wales of a sleeve of the garment.

12. A blank as claimed in claim 9, having apertures, formed during knitting, in said fabric constituting said sleeves and shoulder region, said apertures lying in areas associated with lines dividing each sleeve from the shoulder region, each aperture extending into the fabric from an edge of a sleeve and/or the shoulder region whereby when said fabric constituting sleeves and shoulder region is folded to close said apertures said sleeves are caused to assume a downward inclination in relation to said shoulder region.

13. A blank as claimed in claim 9, having a pouch knitted in the area associated with the line dividing each sleeve from said shoulder region whereby the sleeves in the finished garment are caused to assume a downward inclination in relation to said shoulder region.

* * * * *